US009981294B2

(12) United States Patent
Smith

(10) Patent No.: US 9,981,294 B2
(45) Date of Patent: May 29, 2018

(54) HYDRAULIC FLUSHING SYSTEM

(71) Applicant: GE Oil & Gas UK Limited, Nailsea, Bristol (GB)

(72) Inventor: David Martin Smith, Bristol (GB)

(73) Assignee: GE Oil & Gas UK Limited, Nailsea (GB)

( * ) Notice: Subject to any disclaimer, the term of this patent is extended or adjusted under 35 U.S.C. 154(b) by 617 days.

(21) Appl. No.: 14/560,936

(22) Filed: Dec. 4, 2014

(65) Prior Publication Data

US 2015/0158059 A1 Jun. 11, 2015

(30) Foreign Application Priority Data

Dec. 5, 2013 (GB) ..... 1321510.8

(51) Int. Cl.
*E21B 34/10* (2006.01)
*B08B 9/032* (2006.01)

(52) U.S. Cl.
CPC ..... *B08B 9/0325* (2013.01); *E21B 34/10* (2013.01); *Y10T 137/0419* (2015.04); *Y10T 137/4245* (2015.04)

(58) Field of Classification Search
CPC ..... E21B 34/10; E21B 34/16; E21B 33/0355; E21B 33/035
USPC ..... 166/368, 335
See application file for complete search history.

(56) References Cited

U.S. PATENT DOCUMENTS 4,636,934 A * 1/1987 Schwendemann .. E21B 33/0355 137/624.18
5,564,501 A * 10/1996 Strattan ..... E21B 33/0355 166/321
6,116,268 A * 9/2000 Johnson ..... E21B 34/16 137/458
6,302,210 B1 * 10/2001 Crow ..... E21B 34/10 166/321

(Continued)

FOREIGN PATENT DOCUMENTS

EP 0915230 A2 5/1999
EP 2096254 A2 9/2009

(Continued)

OTHER PUBLICATIONS

Search Report issued in connection with corresponding GB Application No. 1321510.8 dated Jun. 3, 2014.

(Continued)

*Primary Examiner* — Robert E Fuller
*Assistant Examiner* — David Carroll
(74) *Attorney, Agent, or Firm* — GE Global Patent Operation

(57) ABSTRACT

A hydraulic flushing system includes a hydraulic downhole control line that runs from a hydraulic source to a surface controlled sub-surface safety valve of an underwater hydrocarbon extraction facility, where the hydraulic downhole control line includes a directional control valve. The hydraulic flushing system further includes a purge line coupled to the hydraulic downhole control line downstream of the directional control valve to a service line. The purge line includes a fluid isolation valve therein to enable purging of a hydraulic fluid. The hydraulic flushing system further includes a service line coupled to the purge line via the fluid isolation valve to store the purged hydraulic fluid.

11 Claims, 2 Drawing Sheets

(56) References Cited

U.S. PATENT DOCUMENTS

| | | | | |
|---|---|---|---|---|
| 6,659,184 | B1 * | 12/2003 | Tips | E21B 34/10 166/320 |
| 2001/0042624 | A1 * | 11/2001 | Bartlett | E21B 33/0355 166/368 |
| 2003/0230190 | A1 * | 12/2003 | Douglas | E21B 34/10 91/454 |
| 2005/0178560 | A1 * | 8/2005 | Johansen | E21B 23/04 166/374 |
| 2009/0218096 | A1 * | 9/2009 | Vick, Jr. | E21B 23/04 166/250.15 |
| 2010/0212882 | A1 * | 8/2010 | Guven | E21B 23/04 166/65.1 |
| 2012/0168174 | A1 * | 7/2012 | Vaghi | E21B 34/10 166/373 |
| 2013/0056222 | A1 * | 3/2013 | Smith | E21B 17/1035 166/378 |

FOREIGN PATENT DOCUMENTS

| | | | |
|---|---|---|---|
| EP | 2568107 | A1 | 3/2013 |
| GB | 2389596 | A | 12/2003 |

OTHER PUBLICATIONS

European Search Report and Opinion issued in connection with corresponding EP Application No. 4196048.4 dated Jan. 21, 2016.

* cited by examiner

HYDRAULIC FLUSHING SYSTEM

BACKGROUND

This invention relates to a hydraulic flushing system and method of flushing a downhole control line in an underwater, e.g. subsea, hydrocarbon well facility.

Surface controlled sub-surface safety valves (SCSSVs) on production fluid wells are controlled by high pressure hydraulic fluid switched through a directional control valve (DCV). After a period of time, the hydraulic fluid can deteriorate or become contaminated resulting in possible failure of the SCSSV to operate when required. In order to prevent this problem, well operators insist that the design of the hydraulic system allows for flushing of the hydraulic fluid from the hydraulic control lines right down to the SCSSV itself. However, existing methods of achieving this involve a second 'flushing' DCV and typically venting of the flushed hydraulic fluid to the sea. This creates two new problems: a) the hydraulic fluid can be contaminated with particles which can lodge in the flushing DCV causing it to fail to close resulting in total failure of the SCSSV control; and b) the hydraulic fluid, normally not a pollutant when vented to sea, can be contaminated with downhole fluids including hydrocarbons, which cause the hydraulic fluid to become a pollutant. The invention aims to overcome some of the above problems.

FIG. 1 illustrates a typical existing method of flushing a hydraulic line to a SCSSV 1 of a subsea hydrocarbon well facility. High pressure (HP) hydraulic fluid, typically sourced via an umbilical from a surface platform, is fed via a line 2 and a subsea Xmas tree 3, to a subsea control module (SCM) 4, housed in the tree. Reference numeral 5 designates a base plate for the SCM 4.

During normal operation, the SCSSV 1, is opened and closed by operating a DCV 6, whilst a 'flushing' DCV 7 remains closed. In order to flush a hydraulic downhole control line 8 of the SCSSV 1, the DCV 6 is closed, the DCV 7 is opened followed by the opening of DCV 6, allowing control fluid to flow through the hydraulic downhole control line 8, to the SCSSV 1, and then back up a second control line 9 (acting as a purge or flushing line), through the DCV 7, through a flow transmitter 10, if fitted (this component may be omitted in practice), a metallic check valve 11, and finally a seawater check valve 12 before being vented to sea. The orifice in a DCV such as DCV 7 in this system is typically only 3 millimeters in diameter, and is thus prone to blockage from contaminating particles.

As previously described, prior art systems such as the one shown in FIG. 1 suffer from the problem of potential particle and chemical contaminated fluid being flushed into the sea.

SUMMARY OF THE INVENTION

According to a first aspect of the invention there is provided a hydraulic flushing system comprising: a hydraulic downhole control line that runs from a hydraulic source to a surface controlled sub-surface safety valve of an underwater hydrocarbon extraction facility, said hydraulic downhole control line having a directional control valve therein; and a purge line that runs from the hydraulic downhole control line downstream of the directional control valve to a service line, said purge line having a fluid isolation valve therein.

According to a second aspect of the invention there is provided a method of flushing a hydraulic downhole control line, said control line comprising: a hydraulic downhole control line that runs from a hydraulic source to a surface controlled sub-surface safety valve of an underwater hydrocarbon extraction facility, said hydraulic downhole control line having a directional control valve therein; and a purge line that runs from the first hydraulic downhole control line downstream of the directional control valve to a service line, said purge line having a fluid isolation valve therein, said method comprising the steps of: closing the surface controlled sub-surface safety valve; opening the fluid isolation valve; and opening the directional control valve.

The fluid isolation valve could be operated by a hydraulic line which is independent of the hydraulic downhole control line. The fluid in said hydraulic line could be of relatively lower pressure than the fluid in the hydraulic downhole control line.

The service line could be an annulus service line, which in turn could vent into a well fluid production line.

The fluid isolation valve could have an internal orifice of between 0.5 inch (1.27 centimeters) and 2 inches (5.08 centimeters) in diameter.

In an embodiment of the present invention, the flushing DCV in a typical hydraulic fluid flushing system, which is prone to particle contamination blockage, is replaced with a hydraulically operated fluid isolation valve (FIV), which has a much larger fluid flow path orifice, via which contaminated fluid is vented into a well service line, such as an annulus service line, rather than into the sea, which avoids potential sea pollution. The FIV is typically controlled by hydraulic operation.

DETAILED DESCRIPTION OF THE INVENTION

Figure 1:
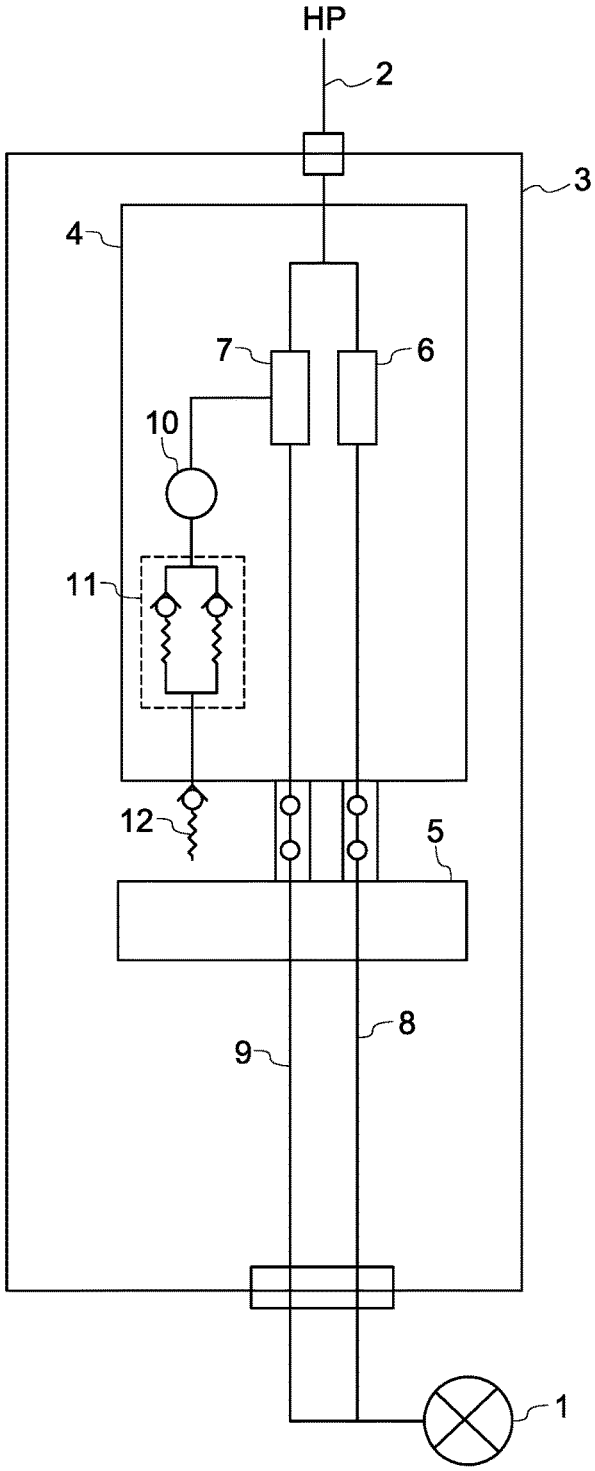
FIG. 1 (Prior Art)
FIG. 1 is a schematic diagram of a prior art flushing system for a hydraulic line.
Figure 2:
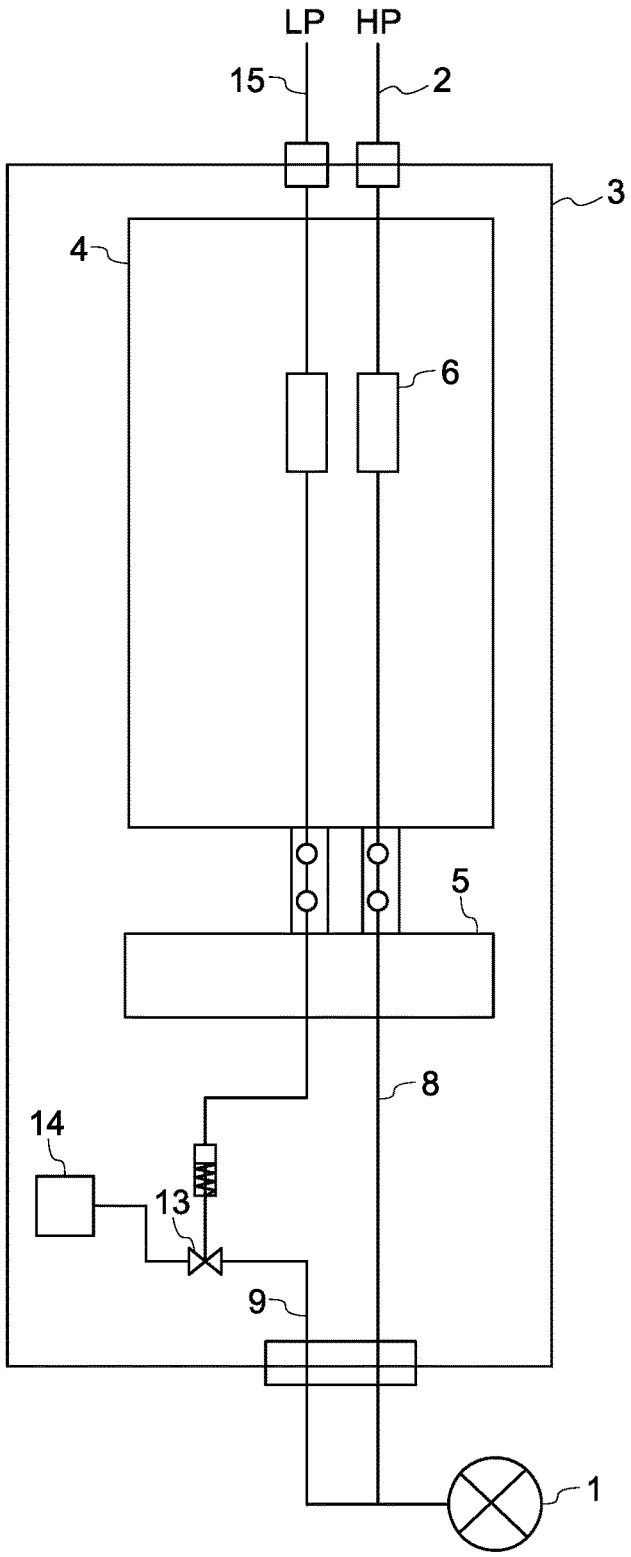
FIG. 2 is a schematic diagram of a flushing system according to an embodiment of the present invention.

FIG. 2 illustrates an embodiment of the invention which aims to remove the problems of the existing system of FIG. 1. Like reference numerals have been retained where appropriate.

As for FIG. 1, high pressure (HP) hydraulic fluid, typically sourced via an umbilical from a surface platform, is fed via line 2 and subsea Xmas tree 3, to a subsea control module (SCM) 4, housed in the tree. A hydraulic downhole control line 8 runs from the hydraulic source to a SCSSV 1 and has a DCV 6 therein. A purge line 9 runs from the hydraulic downhole control line 8 downstream of the DCV 6 to a service line 14, and has a hydraulically operated fluid isolation valve (FIV) 13 therein.

During normal operation, the SCSSV 1 is opened and closed by operating DCV 6, whilst the FIV 13 remains closed. More particularly, while the orifice in a DCV such as DCV 7 is typically only 3 millimeters in diameter, and is thus prone to blockage from contaminating particles, the FIV 13 has an internal orifice that can be between 0.5 inch (1.27 centimeters) and 2 inches (5.08 centimeters) in diameter, and thus is not prone to blockage from contaminating particles.

In order to flush the downhole control line 8, the SCSSV 1 is closed, the FIV 13 is opened and then DCV 6 is opened, allowing control fluid to flow downhole to the SCSSV 1, and then back up the purge line 9, through the FIV 13, and into the service line 14, such as an annulus service line. Once the required amount of fluid has been circulated through the loop, the FIV 13 is closed and normal operation can be resumed.

In the embodiment shown in FIG. 2 the FIV 13 is hydraulically operated via a low pressure (LP) hydraulic line 15 which is independent of the hydraulic downhole control line 8. The fluid of the low pressure hydraulic line 15 is of relatively lower pressure than the fluid in the line 2. In alternative embodiments the FIV 13 may be mechanically operated or electrically controlled, e.g. by a solenoid.

Purged fluid may be stored in the service line 14. On completion of the first part of the flushing activity, the FIV 13 is closed. Then pressure is applied to the service line 14 from a host facility (i.e. a surface platform, a floating production, storage and offloading (FPSO) unit, etc.) and a path opened from the service line 14 into a production line of an underwater hydrocarbon well facility, which allows the purged fluid to be pushed into the production line after which it flows back to the host facility.

The present invention may prevent the failure of the hydraulic control line flushing system from particle contamination.

The present invention may reduce the risk of pollution of the sea due to chemical contamination of flushed and vented hydraulic fluid.

This written description uses examples to disclose the present invention, including the best mode, and also to enable any person skilled in the art to practice the present invention, including making and using any computing system or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of flushing a hydraulic downhole control line, the method comprising the steps of:

closing a surface controlled sub-surface safety valve, wherein the hydraulic downhole control line runs from a hydraulic source to the surface controlled sub-surface safety valve of an underwater hydrocarbon extraction facility;

opening a fluid isolation valve to enable purging of a hydraulic fluid, wherein the fluid isolation valve is operated by a hydraulic line which is independent of the hydraulic downhole control line;

storing the purged hydraulic fluid in a service line; and opening a first directional control valve;

wherein the hydraulic downhole control line comprises the first directional control valve and a purge line that runs from the hydraulic downhole control line downstream of the first directional control valve to the service line, and wherein the purge line comprises the fluid isolation valve controlled via a second directional control valve disposed in the hydraulic line.

2. The method according to claim 1, wherein the fluid isolation valve is operated by a hydraulic line which is independent of the hydraulic downhole control line.

3. The method according to claim 2, wherein the hydraulic fluid in the hydraulic line is of relatively lower pressure than the hydraulic fluid in the hydraulic downhole control line.

4. The method according to claim 1, wherein the service line is an annulus service line.

5. The method according to claim 1, wherein the service line vents into a production line of the underwater hydrocarbon extraction facility.

6. The method according to claim 1, wherein the fluid isolation valve comprises an internal orifice, wherein a diameter of the internal orifice is between 0.5 inch and 2 inches.

7. The method according to claim 5, further comprising:

closing the fluid isolation valve; and applying pressure to the service line to push the purged hydraulic fluid into the production line after closing the fluid isolation valve.

8. A hydraulic flushing system comprising:

a hydraulic downhole control line that runs from a hydraulic source to a surface controlled sub-surface safety valve of an underwater hydrocarbon extraction facility, the hydraulic downhole control line having a first directional control valve therein;

a purge line coupled to the hydraulic downhole control line downstream of the directional control valve and comprising a fluid isolation valve to enable purging of a hydraulic fluid, wherein the fluid isolation valve is operated by a hydraulic line which is independent of the hydraulic downhole control line; and a second directional control valve coupled to the fluid isolation valve to control operation of the fluid isolation valve; and a service line coupled to the purge line via the fluid isolation valve to store the purged hydraulic fluid when the fluid isolation valve is open, and to supply the purged hydraulic fluid to a production line of the underwater hydrocarbon extraction facility when the fluid isolation valve is closed.

9. The hydraulic flushing system according to claim 8, wherein the hydraulic fluid in the hydraulic line is of relatively lower pressure than the hydraulic fluid in the hydraulic downhole control line.

10. The hydraulic flushing system according to claim 8, wherein the service line is an annulus service line.

11. The hydraulic flushing system according to claim 8, wherein the fluid isolation valve comprises an internal orifice, wherein a diameter of the internal orifice is between 0.5 inch and 2 inches.

* * * * *